US008109615B2

(12) United States Patent
Kanbe et al.

(10) Patent No.: US 8,109,615 B2
(45) Date of Patent: Feb. 7, 2012

(54) INK CARTRIDGES

(75) Inventors: Tomohiro Kanbe, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 774 days.

(21) Appl. No.: 11/965,455

(22) Filed: Dec. 27, 2007

(65) Prior Publication Data

US 2009/0058962 A1 Mar. 5, 2009

(30) Foreign Application Priority Data

Aug. 31, 2007 (JP) ..... 2007-225271

(51) Int. Cl.
*B41J 2/175* (2006.01)

(52) U.S. Cl. ..... 347/86; 347/85; 347/7

(58) Field of Classification Search ..... 347/7, 85, 347/86, 5, 9; 399/113
See application file for complete search history.

(56) References Cited

U.S. PATENT DOCUMENTS

| | | | | |
|---|---|---|---|---|
| 5,752,134 | A * | 5/1998 | Hazama et al. | 399/113 |
| 6,796,627 | B2 | 9/2004 | Kimura | |
| 6,923,531 | B2 * | 8/2005 | Saruta | 347/86 |
| 7,192,128 | B1 | 3/2007 | Hattori et al. | |
| 7,775,647 | B2 * | 8/2010 | Okito et al. | 347/86 |
| 2002/0085050 | A1 * | 7/2002 | Aruga et al. | 347/7 |
| 2006/0033789 | A1 | 2/2006 | Sasaki et al. | |
| 2007/0229615 | A1 | 10/2007 | Hattori et al. | |

FOREIGN PATENT DOCUMENTS

| | | | |
|---|---|---|---|
| CN | 101015992 | A | 8/2007 |
| EP | 1097814 | A | 5/2001 |
| EP | 1757453 | A1 | 2/2007 |
| EP | 1772270 | A | 4/2007 |
| EP | 1792736 | A | 6/2007 |
| EP | 1839873 | A | 10/2007 |
| JP | 2001219575 | A | 8/2001 |
| JP | 2001232806 | A | 8/2001 |
| JP | 2005262564 | A | 9/2005 |
| JP | 2005262565 | A | 9/2005 |

OTHER PUBLICATIONS

European Patent Office, European Search Report for Corresponding European Patent Application No. 08003692, mailed on Jul. 3, 2008.
The State Intellectual Property Office of the People's Republic of China; Notification of First Office Action in Chinese Patent Application No. 200810087256.5 (counterpart to the above-captioned U.S. patent application) mailed Nov. 27, 2009.

* cited by examiner

*Primary Examiner* — Lam S Nguyen
(74) *Attorney, Agent, or Firm* — Baker Botts L.L.P.

(57) ABSTRACT

An ink cartridge includes a frame, a first wall comprising a film connected to the frame, and a second wall opposite the first wall. The frame, the first wall, and the second wall define an ink chamber therein, and the ink chamber is configured to store ink therein. The ink cartridge also includes a movable member positioned within the ink chamber, and a shaft extending between the first wall and the second wall. The movable member is configured to pivot about the shaft. Moreover, the frame includes a first material, and the shaft includes a second material which is different than the first material. A rigidity of the second material is greater than a rigidity for the first material.

9 Claims, 7 Drawing Sheets

INK CARTRIDGES

CROSS-REFERENCE TO RELATED APPLICATION

The present application claims priority from Japanese Patent Application No. JP-2007-225271, which was filed on Aug. 31, 2007, the disclosure of which is incorporated herein by reference in its entirety.

BACKGROUND OF THE INVENTION

1. Field of the Invention

The present invention relates generally to ink cartridges. In particular, the present invention is directed towards ink cartridges which comprise a movable member configured to rotate with respect to a shaft positioned in an ink chamber of the ink cartridge.

2. Description of Related Art

A known recording apparatus is configured to detect when an amount of ink within a known ink cartridge is less than a sufficient amount of ink. For example, the ink cartridge includes an arm configured to rotate with respect to a shaft. The rotatable arm is configured to have a float which is positioned at a first end of the arm, and a blocking member which is positioned at a second end of the arm and is configured to move in an opposite direction with respect to the float based on an amount of ink in the ink cartridge. Moreover, the known recording apparatus may include an optical sensor. When there is a sufficient amount of ink within the ink cartridge, the blocking member is positioned below the optical sensor, and light emitted by the optical sensor is not blocked by the blocking member. Nevertheless, as the ink within the ink cartridge is consumed by the recording apparatus, the surface of the ink within the ink cartridge moves downwards, the float moves downwards, and the blocking member moves upwards. When the amount of ink within the ink cartridge reaches an insufficient amount of ink, the blocking member blocks the light from the optical sensor, and the printer determines that there is an insufficient amount of ink within the ink cartridge.

In another known ink cartridge the pressure within the ink chamber is reduced, or the ink cartridge is packaged in a reduced pressure packaging arrangement to prevent gas from dissolving in the ink. In this known ink cartridge, the shaft in the ink chamber may be deformed due to the pressure differential between an interior of the ink cartridge and an exterior of the ink cartridge. When the shaft is deformed, the rotatable arm may not rotate smoothly, which may decrease the accuracy of determining whether there is a sufficient amount of ink in the ink cartridge.

It is possible to increase the rigidity of the ink cartridge, e.g., by including metal in the frame or the like. Nevertheless, although increasing the rigidity of the ink cartridge may decrease a likelihood that the shaft will be deformed, such an increase in rigidity may increase the size of the ink cartridge, e.g., the thickness and the width of the ink cartridge, the weight of the ink cartridge, and the cost of the ink cartridge.

SUMMARY OF THE INVENTION

Therefore, a need has arisen for ink cartridges which overcome these and other shortcomings of the related art. A technical advantage of the present invention is that a shaft of a movable member, e.g., an arm, may not be deformed by a force applied due to a pressure differential between an interior of the ink cartridge and an exterior of the ink cartridge According to an embodiment of the present invention, an ink cartridge comprises a frame, a first wall comprising a film connected to the frame, and a second wall opposite the first wall. The frame, the first wall, and the second wall define an ink chamber therein, and the ink chamber is configured to store ink therein. The ink cartridge also comprises a movable member positioned within the ink chamber, and a shaft extending between the first wall and the second wall. The movable member is configured to pivot about the shaft. Moreover, the frame comprises a first material, and the shaft comprises a second material which is different than the first material. A rigidity of the second material is greater than a rigidity for the first material.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-7, like numerals being used for like corresponding portions in the various drawings.

Figure 1B:
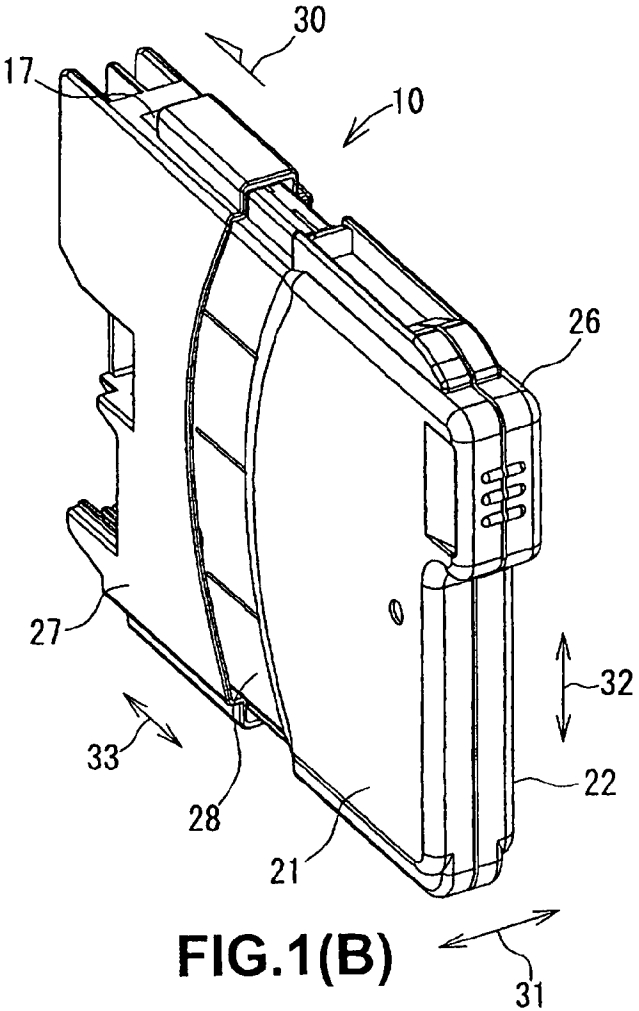
FIGS. 1(A) and 1(B) are a perspective view of a front side and a rear side, respectively, of an ink cartridge, according to the embodiment of the present invention.

Referring to FIG. 1, an ink cartridge 10 may be configured to be removably mounted to an ink jet recording apparatus (not shown), such as an ink jet printer. Specifically, ink cartridge 10 may be mounted in a cartridge storage section (not shown) of the recording apparatus when ink cartridge 10 is inserted in a direction of insertion 30.

Figure 1A:
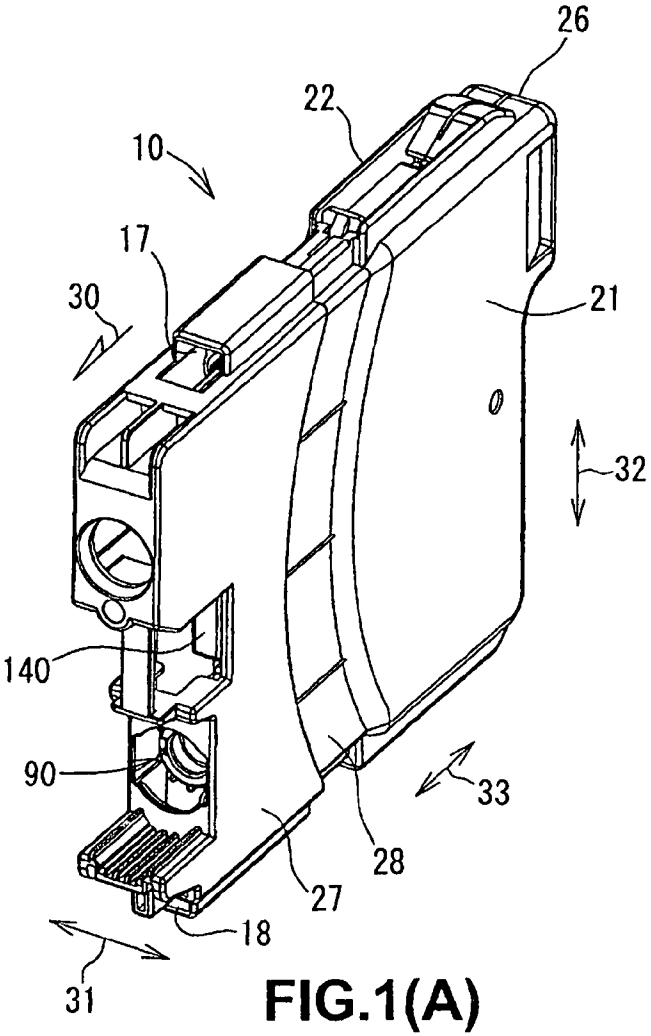
Figure 2:
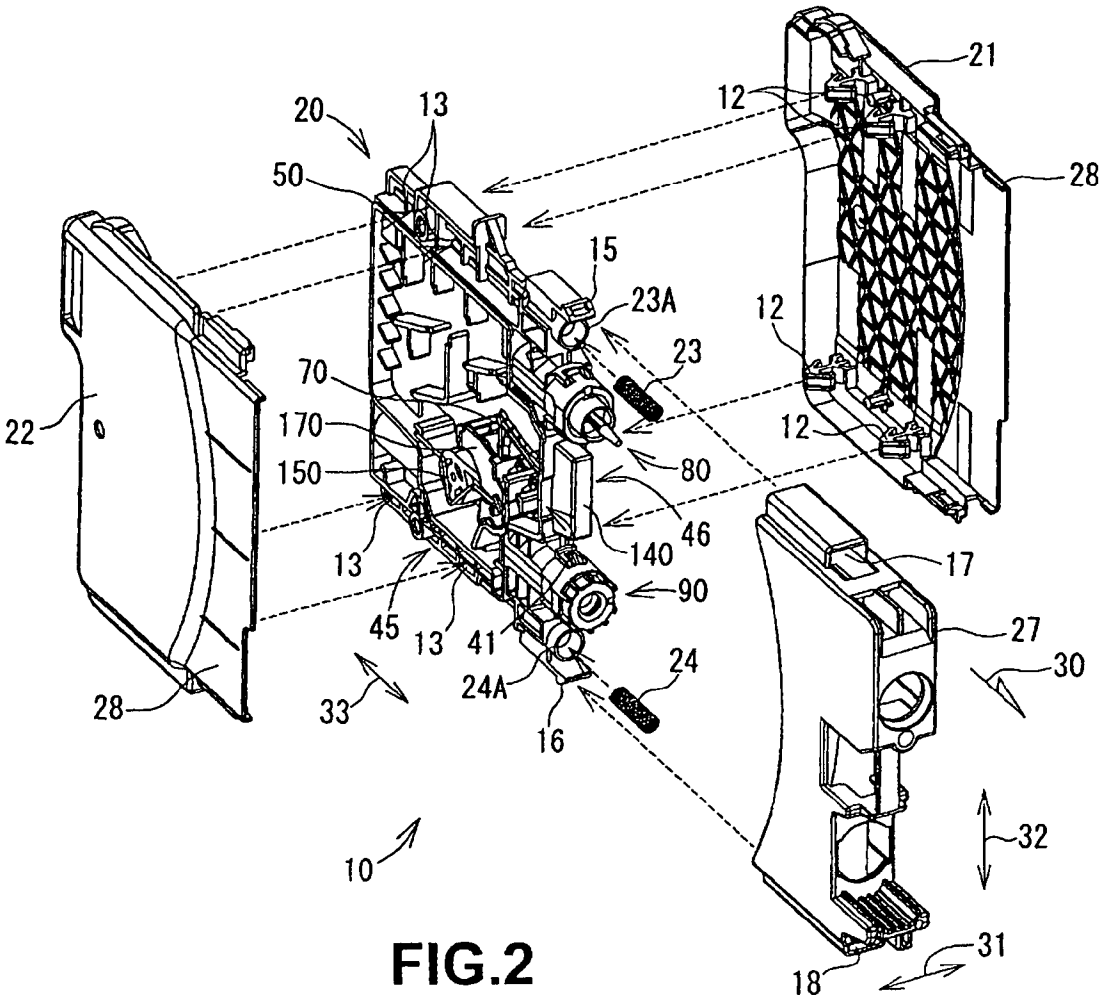
FIG. 2 is an exploded, perspective view of the ink cartridge of FIGS. 1(A) and 1(B).

The ink cartridge 10 may have a substantially flat hexahedron shape, e.g., a substantially rectangular parallelepiped shape, and may be more narrow in a widthwise direction, as indicated by an arrow 31, than in a height direction, as indicated by an arrow 32, and a depth direction, as indicated by an arrow 33. Referring to FIGS. 1(A)-2, the ink cartridge 10 may comprise an ink container 20, a case, e.g., a housing 26, a movable member, e.g., a slider 27, and a pair of coil springs 23 and 24, in which the housing 26 and the slider 27 may form an outer shell of the ink cartridge 10. The ink container 20 may comprise a frame 50, an air communication valve 80, and an ink supply valve 90.

The housing 26 may be configured to protect the ink container 20. For example, each portion of the ink container 20 other than a front surface 41 may be covered by the housing 26. The housing 26 may comprise a first cover 21 and a second cover 22 configured to enclose the ink container 20. The first cover 21 may be attached to a right side surface 46 of the ink container 20 via a plurality of engaging claws 12 positioned on the inner surface of the first cover 21, which engage engaging grooves 13 positioned on the ink container 20. Accordingly the right side surface 46 of the ink container 20 is covered by the first cover 21. Similarly, the second cover 22 is attached to a left side surface 45 of the ink container 20, such that the left side surface 45 of the ink container 20 is covered by the second cover 22. The covers 21 and 22 may have a shape which allows covers 21 and 22 to avoid interfering with the frame 50, the air communication valve 80, and the ink supply valve 90.

The slider 27 may be configured to protect the air communication valve 80 and the ink supply valve 90. The slider 27 may be removably attached to the ink container 20, and an inner surface of the slider 27 may contact the coil springs 23 and 24. The coil spring 23 may be mounted to a spring receiver 23A formed at the upper portion of the front surface 41 of the ink container 20, the coil spring 24 may be mounted to a spring receiver 24A formed at the bottom portion of the front surface 41, and the engaging claws 15 and 16 may engage a pair of engaging grooves 17 and 18, respectively, positioned on the slider 27, such that a front portion 28 of the housing 26 is covered by the slider 27.

Figure 3A:
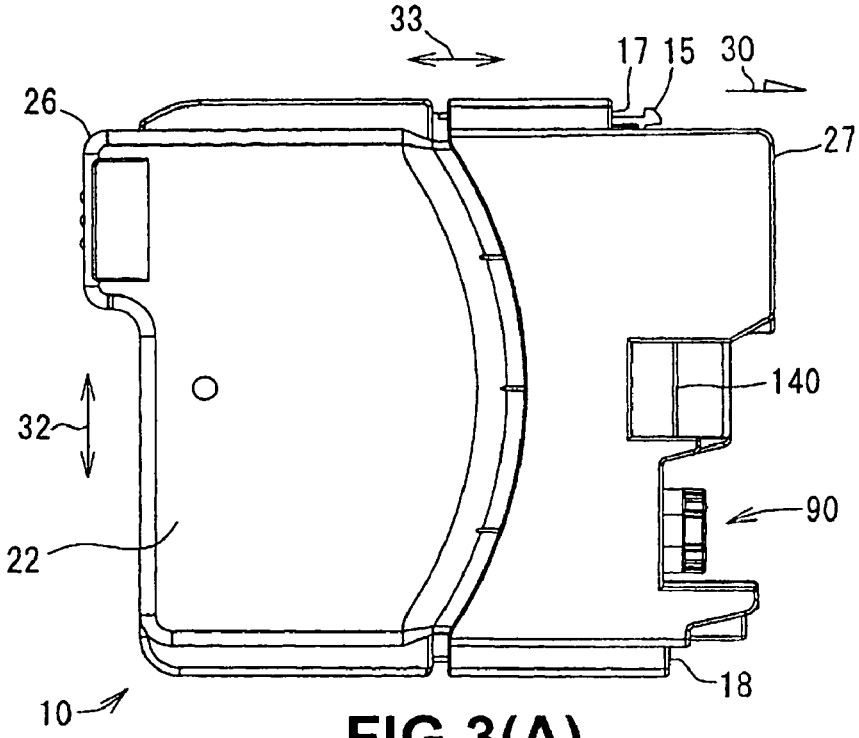
FIG. 3 is a side view of the ink cartridge of FIGS. 1(A) and 1(B).
Figure 3B:
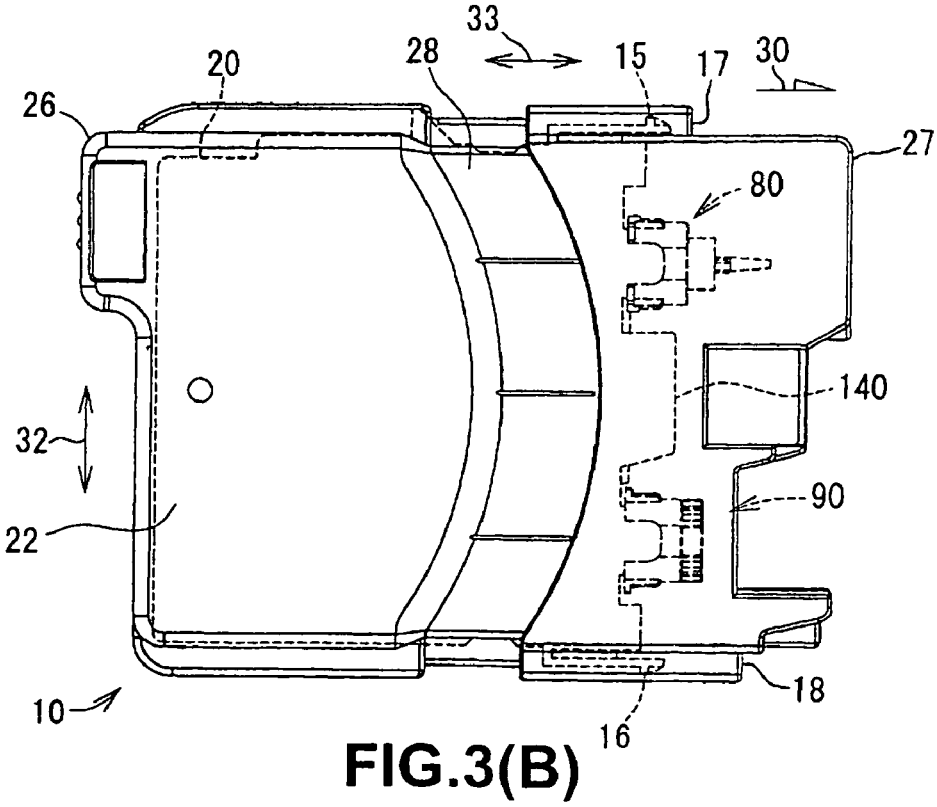
Figure 4:
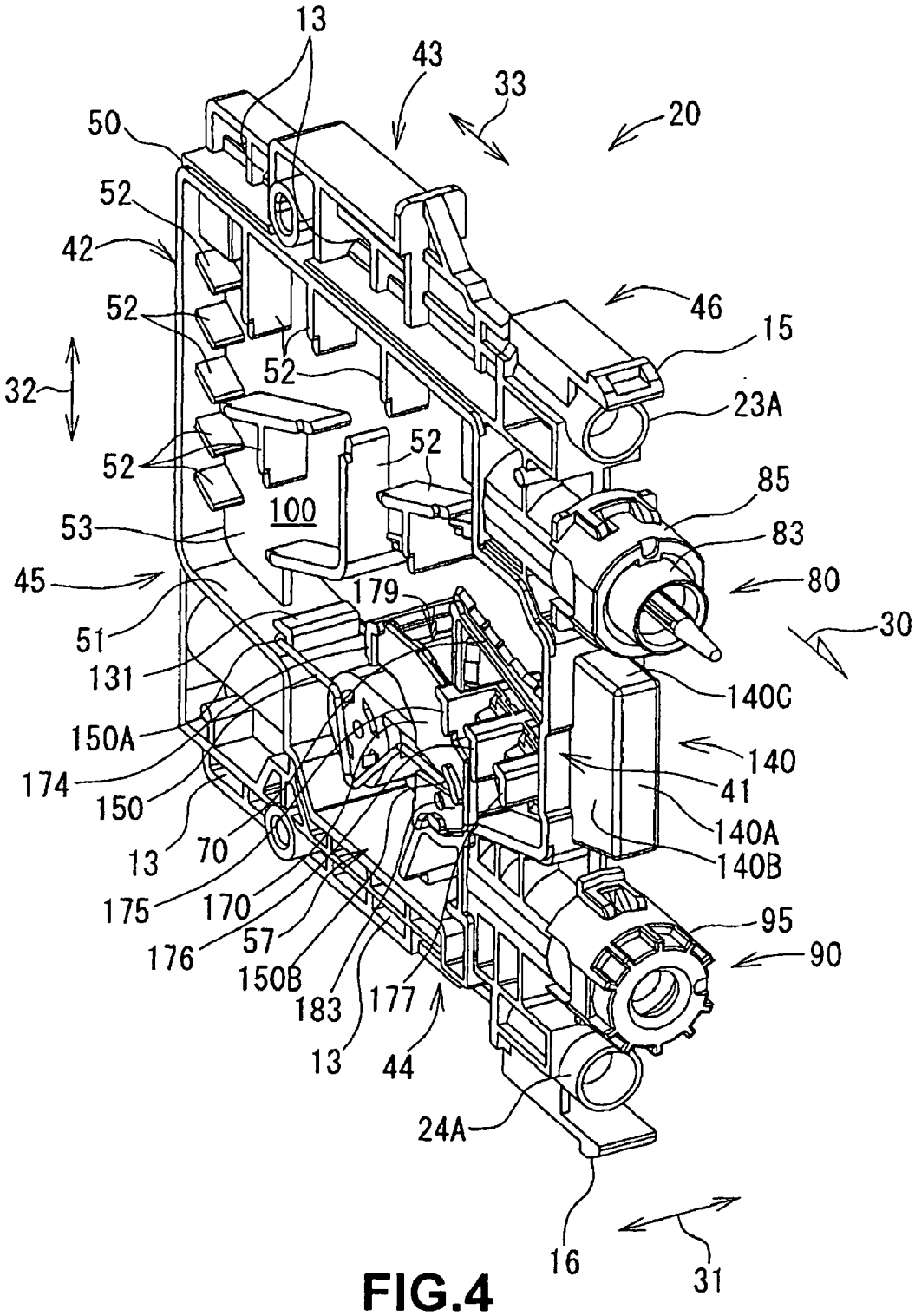
FIG. 4 is an enlarged, perspective view of an ink container, according to an embodiment of the present invention.

The slider 27 may be configured to slide in the depth direction along the front portion 28 of the housing 26. Referring to FIGS. 3(A) and 3(B), slider 27 may be configured to move between a first position, as shown in FIG. 3(B), and a second position, as shown in FIG. 3(A). When the slider 27 is in the first position, the slider 27 may be positioned further from the front surface 41 than when the slider 27 is in the second position. When the slider 27 is in the second position, the air intake valve 80 and the ink supply valve 90 may be exposed to the outside via a pair of openings formed in the slider 27, when the slider 27 is in the first position, the slider 27 may enclose the air communication valve 80 and the ink supply valve 90.

Referring to FIGS. 4-7, the ink container 20 may have substantially the same contour and shape as the ink cartridge 10. When the ink cartridge 10 is mounted to a cartridge storage section (not shown) of the recording apparatus, the cartridge storage section may receive the ink container 20 with the slider 27 in the second position. In this embodiment, the ink container 20 may comprise front surface 41, a rear surface 42 opposite the front surface 41, an upper surface 43, a lower surface 44 opposite the upper surface 43, a left side surface 45, and a right side surface 46 opposite the left side surface 45, such that surfaces 41-46 define an enclosure therein. An area of surfaces 45 and 46 may be greater than an area of each of surfaces 41-44.

The ink container 20 may comprise frame 50, an arm 70, a supporting block 170, a spring member 150, the air communication valve 80, the ink supply valve 90, and at least one film 65, e.g., a pair of films 65. The frame 50 may be a housing of the ink container 20 which defines surfaces 41-46. The frame 50 may comprise a translucent resin, e.g., a transparent resin, and may be formed by injection molding. For example, the frame 50 may comprise polypropylene, polyacetal, nylon, or the like, or any combinations thereof.

The frame 50 may comprise an outer peripheral wall 51 and a plurality of inner walls 52. The inner walls 52 are arranged inside the outer peripheral wall 51. The outer peripheral wall 51 and the inner walls 52 may be integral with the frame 50. The outer peripheral wall 51 and the inner walls 52 may extend from the left side surface 45 to the right side surface 46 of the ink container 20. The outer peripheral wall 51 may be disposed in an annular shape along the front surface 41, the upper surface 43, the rear surface 42 and the lower surface 44 to define a space in the interior thereof. Accordingly, an opening 57 may be positioned on each of the left side surface 45 and the right side surface 46 of the frame 50.

The pair of films 65, e.g., translucent films, may be connected to, e.g., adhered to the left side surface 45 and the right side surface 46, respectively, of the frame 50 via an adhesion method, e.g., a thermal adhesion method. More specifically, the films 65 are adhered to both end portions of the outer peripheral wall 51 in the widthwise direction 31. Accordingly, the openings 57 are covered by the films 65, and a space surrounded by the outer peripheral wall 51 and the films 65 is defined as an ink chamber 100. Alternatively, a box-shaped frame which is opened on one side only may be employed instead of the frame 50. In this case, the ink chamber 100 is defined by the film 65 adhered on the opened side of the box shaped frame.

The inner walls 52 may be surrounded by the outer peripheral wall 51. The frame 50 may comprise a partitioning panel 53 which partitions an upper space of the ink chamber 100 at the center in the widthwise direction 31 integrally with the outer peripheral wall 51. The inner walls 52 may be integral with the outer peripheral wall 51 or the partitioning panel 53. The films 65 may be adhered to the inner walls 52 at the both end portions in the widthwise direction 31. Accordingly, inward deformation of the films 65 may be prevented or suppressed. Moreover, although the first cover 21 and the second cover 22 may deform toward the ink container 20, deformation of the first cover 21 and the second cover 22 may be prevented or suppressed by the inner walls 52. Consequently, the ink container 20 and the films 65 may not be damaged. The lower portion of the ink chamber 100, e.g., a space 102, below the partitioning panel 53 may not be partitioned in the widthwise direction 31.

The film 65 may comprise a plurality of synthetic resin films and may have a multilayer structure. For example, the film 65 may have a three-layer structure having a first layer comprising polypropylene, a second layer comprising nylon, and a third layer comprising polyethylene terephthalate laminated, such that the first layer on the side of the ink chamber 100 may comprise the same material as the frame 50. Alternatively, the films 65 may comprise a pulp, a metal, a natural resin, or the like.

A bearing plate 74 may be positioned at the center of the outer peripheral wall 51 in the widthwise direction and may protrude therefrom. The bearing plate 74 may be positioned at the outer peripheral wall 51 adjacent to a corner defined by the front surface 41 and the lower surface 44. The bearing plate 74 may be positioned at the end portion in the outer peripheral wall 51 on the side of the right side surface 46, and may protrude therefrom. The bearing plate 74 may have a bearing 67, e.g., a circular bearing, positioned on the surface thereof on the side of the left side surface 45. A shaft 77, e.g., a shaft having a column shape, may be fitted to the bearing 67, and a shaft opening 78 of the arm 70 may be fitted on the shaft 77. The other end of the shaft 77 is supported by the supporting block 170.

An ink injection portion 105 may be positioned at the rear surface 42 of the frame 50. The ink injection portion 105 may have a circular hole formed therethrough, which may allow fluid communicate between the rear surface 42 and the ink chamber 100. The ink injection portion 105 may be integral with the frame 50 adjacent to the lower end of the rear surface 42. The ink injection portion 105 communicates with the ink chamber 100. Ink is injected into the ink chamber 100 through the ink injection portion 105.

The front surface 41 of the frame 50 may have a translucent portion 140 extending therefrom. The translucent portion 140 may be used to detect the amount of ink stored in the ink chamber 100. The translucent portion 140 may be integral with the frame 50, and may comprise the same material as the frame 50. The translucent portion 140 may be irradiated with light by an optical sensor, such as a photo interrupter, attached to the recording apparatus. The optical sensor has a light-emitting element and a light-receiving element. In this embodiment, the side wall 140B may be irradiated with light emitted from the light-emitting element, and light which passes through the side wall 140B may be received by the light-receiving element.

The translucent portion 140 may protrude outward from a portion of the front surface 41 adjacent to the middle portion thereof. The translucent portion 140 may be defined by five wall surfaces forming a substantially rectangular shape, and the space 142 may correspond to an interior thereof, and may have a hollow rectangular box shape. For example, the translucent portion 140 may be defined by a front wall 140A extending in parallel to the front surface 41, a pair of side walls 140B, an upper wall 140C, and a bottom wall 140D including. The width of the front wall 140A may be less than the width of the front surface 41. Moreover, the space 142 may be in fluid communication with the ink chamber 100.

The air communication valve 80 may be positioned above the translucent portion 140. The air communication valve 80 may be configured to selectively open and close a through hole 81 to allow fluid communication with the atmosphere positioned on the upper portion of the front surface 41. The air communication valve 80 may comprise a valve body 87, a spring 86, a sealing member 83, and a cap 85. The air communication valve 80 may close the through hole 81 when the ink cartridge 10 is not mounted to the recording apparatus, and may open the through hole 81 when mounted to the recording apparatus. As such, the pressure of an air layer in the ink chamber 100 is equalized with the atmospheric pressure. Alternatively, the air communication valve 80 may be replaced by a vinyl adhesive tape or film.

The ink supply valve 90 may be positioned below the translucent portion 140. The ink supply valve 90 may be configured to selectively open and close a through hole 91 to allow ink to be dispensed from an interior of ink chamber 100 to an exterior of ink chamber 100. The ink supply valve 90 may comprise a valve body 97, a spring 96, a spring receiver 94, a sealing member 93, and a cap 95. The ink supply valve 90 may close the through hole 91 when the ink cartridge 10 is not mounted to the recording apparatus, and may open the through hole 91 when the ink cartridge 10 is mounted to the recording apparatus and an ink needle (not shown) applies a force to the ink supply valve 90, such that ink in the ink chamber 100 may be dispensed from the ink chamber 100 to the recording apparatus through the ink needle.

The arm 70 may be used to determine the amount of ink stored in the ink chamber 100 is greater than a predetermined amount of ink. The arm 70 may comprise an indicator portion 72 which may be positioned at a first end of the arm 70. The indicator portion 72 may be configured to be positioned within the inner space 142 or outside the inner space 142 based on the amount of ink in the ink chamber 100. The arm 70 also may comprise a float portion 73 positioned at a second end of the arm 70.

The arm 70 may have a shaft hole 78 formed therethrough at substantially a center thereof. The shaft 77 may be inserted into the shaft hole 78. The shaft 77 may be configured to rotatably support the arm 70, and may be supported by the bearing 67 positioned on the bearing plate 74 at a first end thereof, and by the supporting block 170 at second end thereof. The arm 70 may be rotatably supported by the shaft 77 to be pivotable in the first direction and the second direction, which is perpendicular to the widthwise direction. The shaft 77 may be separate from or integral with the arm 70.

The front surface 41 of the frame 50 may have a translucent portion 140 extending therefrom. The translucent portion 140 may be used to detect the amount of ink stored in the ink chamber 100. The translucent portion 140 may be integral with the frame 50, and may comprise the same material as the frame 50. The translucent portion 140 may be irradiated with light by an optical sensor, such as a photo interrupter, attached to the recording apparatus. The optical sensor has a light-emitting element and a light-receiving element. In this embodiment, the side wall 140B may be irradiated with light emitted from the light-emitting element, and light which passes through the side wall 140B may be received by the light-receiving element.

The translucent portion 140 may protrude outward from a portion of the front surface 41 adjacent to the middle portion thereof. The translucent portion 140 may be defined by five wall surfaces forming a substantially rectangular shape, and the space 142 may correspond to an interior thereof, and may have a hollow rectangular box shape. For example, the translucent portion 140 may be defined by a front wall 140A extending in parallel to the front surface 41, a pair of side walls 140B, an upper wall 140C, and a bottom wall 140D including. The width of the front wall 140A may be less than the width of the front surface 41. Moreover, the space 142 may be in fluid communication with the ink chamber 100.

The air communication valve 80 may be positioned above the translucent portion 140. The air communication valve 80 may be configured to selectively open and close a through hole 81 to allow fluid communication with the atmosphere positioned on the upper portion of the front surface 41. The air communication valve 80 may comprise a valve body 87, a spring 86, a sealing member 83, and a cap 85. The air communication valve 80 may close the through hole 81 when the ink cartridge 10 is not mounted to the recording apparatus, and may open the through hole 81 when mounted to the recording apparatus. As such, the pressure of an air layer in the ink chamber 100 is equalized with the atmospheric pressure. Alternatively, the air communication valve 80 may be replaced by a vinyl adhesive tape or film.

The ink supply valve 90 may be positioned below the translucent portion 140. The ink supply valve 90 may be configured to selectively open and close a through hole 91 to allow ink to be dispensed from an interior of ink chamber 100 to an exterior of ink chamber 100. The ink supply valve 90 may comprise a valve body 97, a spring 96, a spring receiver 94, a sealing member 93, and a cap 95. The ink supply valve 90 may close the through hole 91 when the ink cartridge 10 is not mounted to the recording apparatus, and may open the through hole 91 when the ink cartridge 10 is mounted to the recording apparatus and an ink needle (not shown) applies a force to the ink supply valve 90, such that ink in the ink chamber 100 may be dispensed from the ink chamber 100 to the recording apparatus through the ink needle.

The arm 70 may be used to determine the amount of ink stored in the ink chamber 100 is greater than a predetermined amount of ink. The arm 70 may comprise an indicator portion 72 which may be positioned at a first end of the arm 70. The indicator portion 72 may be configured to be positioned within the inner space 142 or outside the inner space 142 based on the amount of ink in the ink chamber 100. The arm 70 also may comprise a float portion 73 positioned at a second end of the arm 70.

The arm 70 may have a shaft hole 78 formed therethrough at substantially a center thereof. The shaft 77 may be inserted into the shaft hole 78. The shaft 77 may be configured to rotatably support the arm 70, and may be supported by the bearing 67 positioned on the bearing plate 74 at a first end thereof, and by the supporting block 170 at second end thereof. The arm 70 may be rotatably supported by the shaft 77 to be pivotable in the first direction and the second direction, which is perpendicular to the widthwise direction. The shaft 77 may be separate from or integral with the arm 70.

The interior of the float portion 73 may be hollow, and may float on ink. Alternatively, the float portion 73 may have a specific gravity which is less than the specific gravity of ink. Therefore, the float portion 73 may be displaced upward when a level of the ink in the chamber 100 is reduced to be lower than a predetermined ink level, and the arm 70 rotates in accordance with the movement of the float portion 73. In this embodiment, the float portion 73 may be configured to allow a second portion 76 from the shaft hole 78 to the float portion 73 float in the ink.

Figure 5:
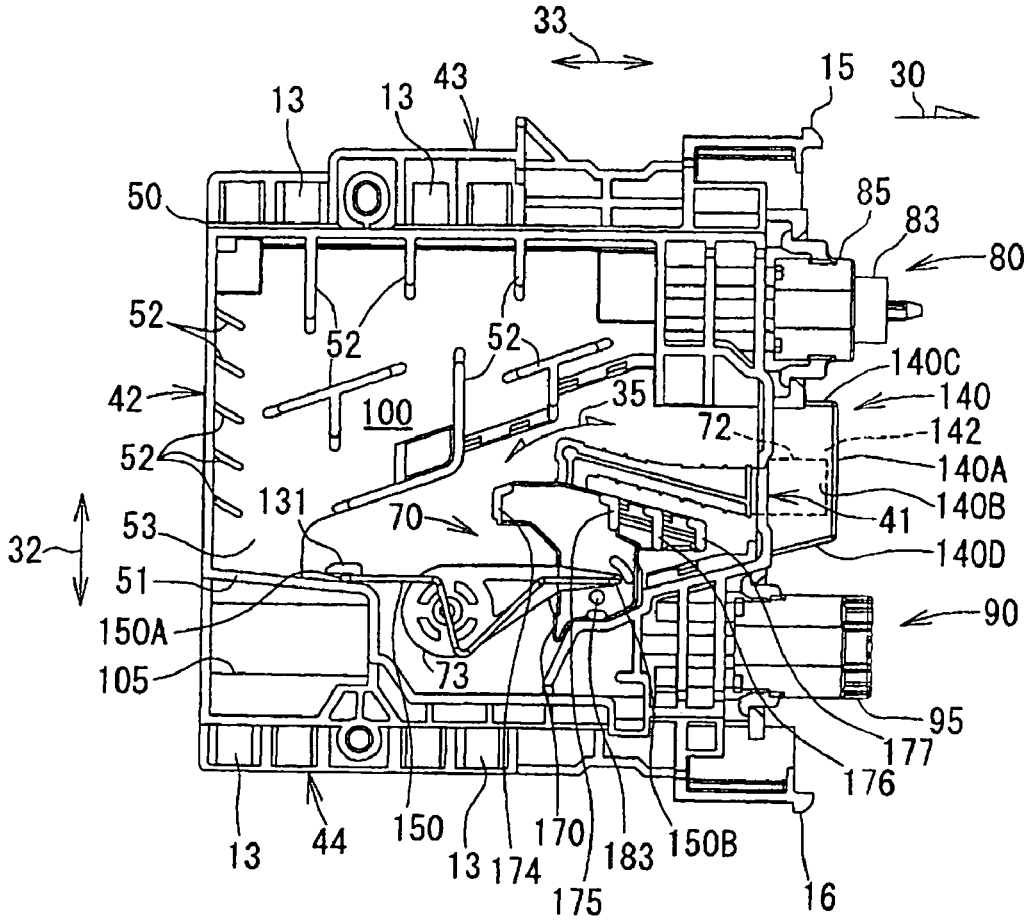
FIG. 5 is a side view of the ink container of FIG. 4.
Figure 6:
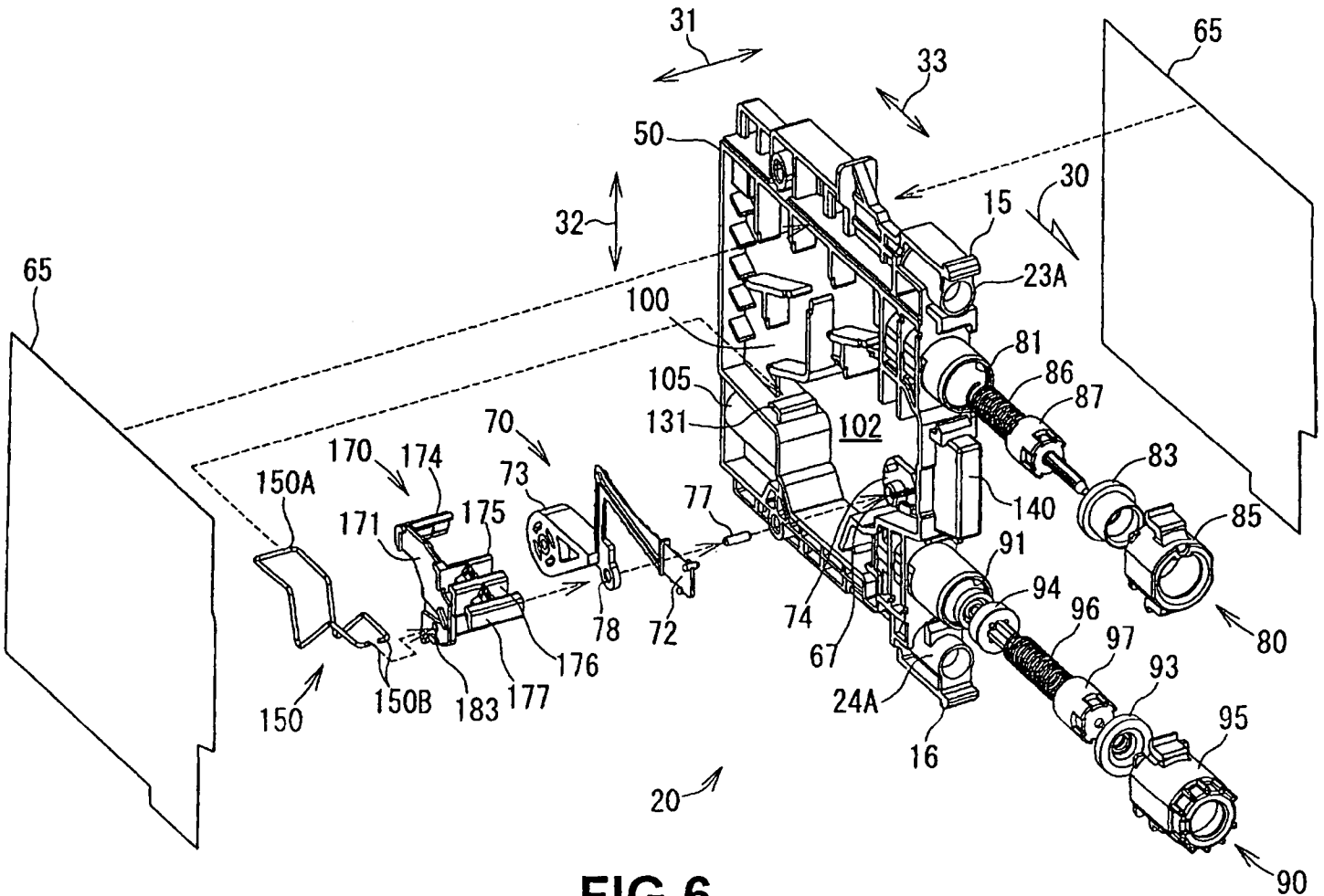
FIG. 6 is an exploded, perspective view of the ink container of FIG. 4.
Figure 7:
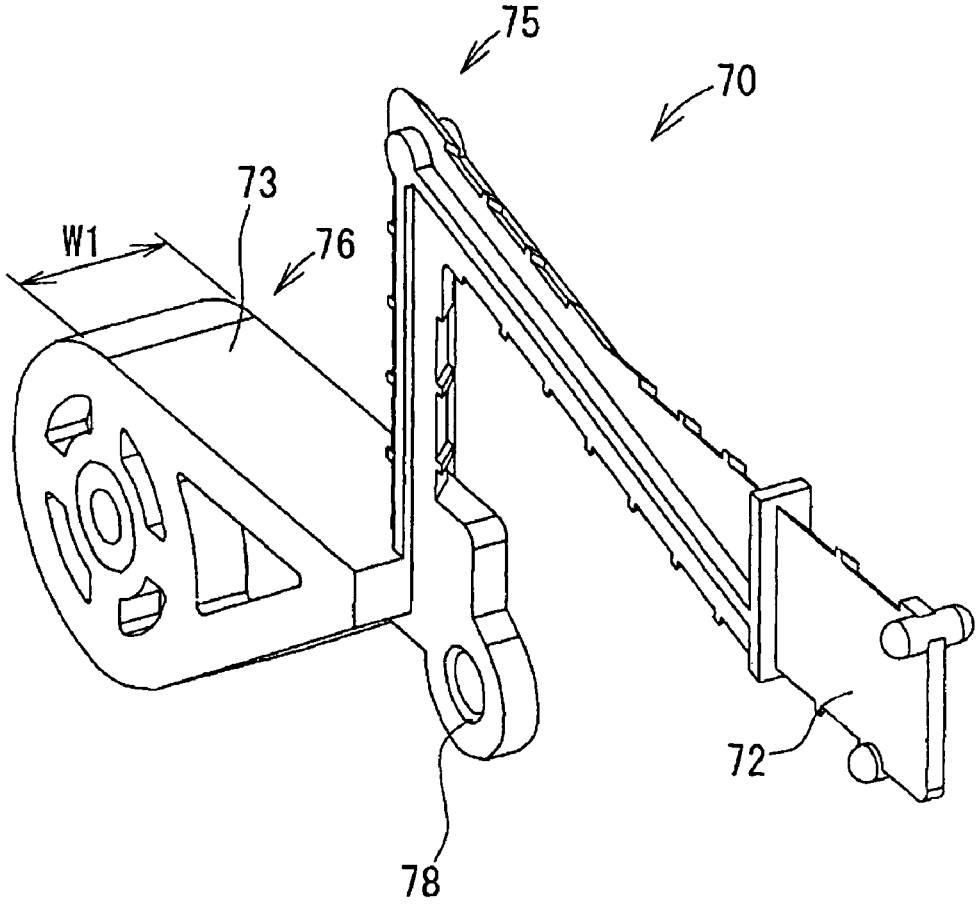
FIG. 7 is a perspective view of an arm, according to an embodiment of the present

The indicator portion 72 may be configured to indicate whether the amount of ink remaining in the ink chamber 100 is less than a sufficient amount of ink. When the arm 70 is rotated clockwise as shown in FIG. 5, the indicator portion 72 moves into the space 142 of the translucent portion 140. The indicator portion 72 which may contact the inner surface of the bottom wall 140D of the translucent portion 140 to prevent the further rotation thereof, and to position the arm 70 in a first position. When the arm 70 is rotated counterclockwise in FIG. 5, the indicator portion 72 moves away from the bottom wall 140D toward a second position.

In this embodiment, the second portion 76 may have a weight which is greater than a weight of a first portion 75 extending from the shaft hole 78 toward the indicator portion 72, such that in the air, the second portion 76 is heavier than the first portion 75. Consequently, when the amount of ink within the ink chamber 100 is relatively low, the arm 70 rotates counterclockwise in FIG. 5 about the shaft 77, and the indicator portion 72 moves out of the space 142 of the translucent portion 140 to indicate that the amount of ink in the ink chamber 100 is less than a sufficient amount of ink.

When the float portion 73 is positioned in the ink, a buoyancy is generated at the float portion 73, such that the arm 70 rotates clockwise in FIG. 5 about the shaft 77, and the indicator portion 72 moves into the space 142 of the translucent portion 140 and is positioned at the first position, which indicates that the amount of ink in the ink chamber 100 is greater than the predetermined amount of ink. Alternatively, the 70 may be replaced by a floating member (not shown) to provide an indication as to whether the amount of ink in the ink chamber is greater than a sufficient amount of ink.

The spring member 150 may be attached around the arm 70. The spring member 150 may be fabricated by bending a linear steel member, such as a wire or a line. The spring member 150 may comprise a pair of end portions 151 and 152, a pair of protecting portions 153 and 154, and a connecting portion 155. The spring member 150 may be fixed to the frame 50 by engaging the connecting portion 155 with a hook 131 formed on the frame 50, and inserting the end portions 151 and 152 into a hole (not shown) formed in the bearing plate 74 and a hole 183 formed in the supporting block 170, respectively.

The spring member 150 may surround the float portion 73 of the arm 70. For example, the protecting portion 153 may be positioned on the side of the left side surface 45 of the frame 50, and the protecting portion 154 may be positioned on the side of the right side surface 46, such that the both sides of the float portion 73 are surrounded by the protecting portions 153 and 154. Because the protecting portions 153 and 154 may be bent into a substantially V-shape, the protecting portions 153 and 154 may be positioned both sides of the float portions 73 independent of the position of the float portion 73 which is configured to move within the ink chamber 100 based on the amount of ink in the ink chamber 100.

The protecting portions 153 and 154 may be resiliently deformable. Therefore, when the films 65 receive the external force are deformed toward the ink chamber 100, the protecting portions 153 and 154 deform resiliently toward the float portion 73 together with the films 65 by an external force. Nevertheless, when the external force is damped, those portions of the films 65 which deformed toward the ink chamber 100 are urged outward and away from the float portion 73 by resilient restoration.

A method of filling the ink container 20 ink, and a method of manufacturing the ink container 20, will now be described. The method of manufacturing the ink container may comprise a first step for injecting ink into the ink chamber 100, and a second step for decreasing the pressure inside ink chamber 100 to be less than the atmospheric pressure. The arm 70, the shaft 77, the spring member 150, the supporting block 170, the air communication valve 80, the ink supply valve 90 may be assembled to the frame 50, and the films 65 may be adhered to the left side surface 45 and the right side surface 46 of the frame 50, respectively.

The ink chamber 100 may comprise the ink injection portion 105 for injecting ink, and a needle (not shown) or the like for injecting ink may be connected to the ink injection portion 105 to inject a predetermined amount of ink into the ink chamber 100. Prior to the first step, or together with the first step, the second step may be implemented. For example, air in the ink chamber 100 may be reduced and discharged to reduce the pressure in the ink chamber 100, ink then may be injected into the ink chamber 100 through the ink injection portion 105 using the pressure differential between the interior and the exterior of the ink chamber 100. This method of injecting ink may be referred to as a pressure-reducing injection method or a vacuum injection method. When the pressure in the ink chamber 100 is reduced, dissolution of air into the ink may be prevented or substantially prevented, and generation of air bubbles in the ink chamber 100 may be prevented or substantially prevented.

After the ink is injected, the air communication valve 80 is closed, and the pressure of an air layer in the ink chamber 100 is maintained at a pressure which is less than the atmospheric pressure. Therefore, the films 65 deform toward the ink chamber 100 by the pressure differential between the interior and the exterior of the ink chamber 100. The housing 26 and the slider 27 are assembled to the ink container 20, such that the ink cartridge 10 is completed. The ink cartridge 10 then may be positioned in a bag-shaped package material and packed with air in the package material discharged, as needed.

The external force caused by such a pressure reduction also may act on the shaft 77. Nevertheless, because the shaft 77 may comprise stainless steel, the compression strength in the axial direction may be greater than the frame 50, and consequently, is not deformed by the external force which is applied to the films 65. Because the bearing plate 74 and the supporting block 170 disposed at the both ends of the shaft 77 support the respective films 65 with planes, the films 65 are prevented from deforming toward the space 102 or the arm 70. Consequently, the arm 70 rotates smoothly in the ink chamber 100, and accurate detection of the amount of ink is achieved.

The ink cartridge 10 is removed from the package material, and is mounted to the cartridge storage section provided in the recording apparatus. When the ink cartridge is mounted to the recording apparatus, the air communication valve 80 is opened. Consequently, the air layer in the ink chamber 100 is drawn into the atmosphere, and the external force which deforms the films 65 is faded out.

When ink in the ink container 20 is consumed, ink may be refilled in the ink container 20. When refilling ink, the second step described above may be omitted. When ink is disappeared from the ink chamber 100, the pressure of the ink with respect to the films 65 is faded out, and hence the films 65 may deform toward the ink chamber 100. Nevertheless, because the films 65 are supported by the shaft 77, the bearing plate 74 and the supporting block 170, the films 65 may not deflect toward the space 102. Consequently, reduction of the capacity of the ink chamber 100 due to the deformation of the films 65 may be avoided, and the ink chamber 100 readily may be refilled with ink.

Because the peripheral surface of the shaft 77 is smooth, the rotation of the arm 70 is also smooth, and further accurate detection of the amount of ink is achieved.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge comprising:

a frame;

a first wall comprising a film connected to the frame;

a second wall opposite the first wall, wherein the frame, the first wall, and the second wall define an ink chamber therein, and the ink chamber is configured to store ink therein;

a movable member positioned within the ink chamber; and a shaft extending between the first wall and the second wall, wherein the movable member is configured to pivot about the shaft, the frame comprises a first material, and the shaft comprises a second material which is different than the first material, wherein a rigidity of the second material is greater than a rigidity for the first material, wherein the movable member comprises a third material, wherein a friction coefficient between the second material and the third material is less than a friction coefficient between the first material and the third material.

2. The ink cartridge of claim 1, wherein the second wall comprises a film connected to the frame.

3. The ink cartridge of claim 1, wherein the shaft is configured to support the first wall and the second wall.

4. The ink cartridge of claim 1, wherein the frame comprises a synthetic resin, and the shaft comprises a metal.

5. The ink cartridge of claim 4, wherein the metal comprises a stainless steel.

6. The ink cartridge of claim 1, wherein outer surface of the shaft is substantially unroughened.

7. The ink cartridge of claim 1, wherein the third material is the same as the first material.

8. The ink cartridge of claim 1, wherein the movable member comprises:

a pivot center having an pivot opening formed therethrough;

an arm; and a float portion, wherein the arm comprises a first portion connected to the pivot center, and a second portion connected to the pivot center and the float portion, wherein at least a portion of the shaft is positioned within the pivot opening, and the movable member is configured to pivot about the shaft between a first position and a second position based on an amount of ink in the ink chamber.

9. The ink cartridge of claim 8, further comprising a translucent portion extending from the ink chamber, wherein the translucent portion has an inner space formed therein, and the inner space is configured to be in fluid communication with the ink chamber, wherein at least a portion of the first portion of the arm is configured to be positioned within the inner space of the translucent portion.

* * * * *